US006463665B1

(12) United States Patent
Gomez-Vazquez

(10) Patent No.: US 6,463,665 B1
(45) Date of Patent: Oct. 15, 2002

(54) REAR BOW SIGHT FOR AN ARCHERY BOW

(76) Inventor: Jose Gomez-Vazquez, 119 Sunset Dr., Laredo, TX (US) 78041

( * ) Notice: Subject to any disclaimer, the term of this patent is extended or adjusted under 35 U.S.C. 154(b) by 0 days.

(21) Appl. No.: 09/847,271

(22) Filed: May 2, 2001

(51) Int. Cl.[7] ..... F41G 1/06; F41G 1/467
(52) U.S. Cl. ..... 33/265; 124/87
(58) Field of Search ..... 33/265, 227, 263; 124/87

(56) References Cited

U.S. PATENT DOCUMENTS 4,982,503 A 1/1991 Land
5,040,301 A 8/1991 Forbis
5,086,567 A * 2/1992 Tutsch ..... 33/265
5,205,268 A 4/1993 Savage
5,454,169 A 10/1995 Keller
5,802,726 A 9/1998 Trosper, Jr.
5,975,069 A * 11/1999 Hamm et al. ..... 124/87
6,119,672 A * 9/2000 Clossen ..... 124/87

* cited by examiner

*Primary Examiner*—Diego Gutierrez
*Assistant Examiner*—Tania Courson
(74) *Attorney, Agent, or Firm*—Richard R. Ruble; Jackson Walker L.L.P.

(57) ABSTRACT

An archery bow rear sight adapted for use with any front sight, including a multi-pin front sight. The rear sight of the present invention comprising a flexible tension bearing member capable of retaining a sighting cross hair under constant tension. The rear sight of the present invention is attached to the archery bow using attachment means that allow convenient horizontal and vertical adjustment of the rear sight.

20 Claims, 5 Drawing Sheets

REAR BOW SIGHT FOR AN ARCHERY BOW

FIELD OF THE INVENTION

This invention relates generally to archery equipment and in particular to a bow-mounted rear site for improving shooting accuracy.

BACKGROUND OF THE INVENTION

An archery bow has long been recognized as a difficult weapon to fire with consistent accuracy. Conventional firing calls for the archer to sight the target by aiming along the shaft of the arrow. Depending on where the arrow falls in relation to the target, the archer will compensate it accordingly. Compensation may be required for such factors as distance, wind, speed and size of the target. Due to the extreme difficulty of making these compensations, the need for a device by which the archer may accurately sight the target is well known in the art.

Various types of bow sights are known in the art. Many of these sights employ only a single sighting element or pin mounted adjacent to the bow. The archer uses the bow string or a sighting eyelet positioned in the bow string in conjunction with the sight pin to aim the arrow. One limitation of such sighting devices is that when the string is drawn close to the archer's eye, the archer will have a blurred view of the sight pin, which makes it difficult to accurately aim at the target. Another limitation is that each archer normally positions the drawn string in a slightly different relationship relative to his body, depending upon his own shooting style. Therefore, inaccurate and inconsistent shooting may result.

Other sighting devices use front and rear sights to facilitate aiming at the target. For example, U.S. Pat. No. 5,454,169, describes a front and rear sight for use in compensating for improper torsional positioning of the archery bow. The '169 patent describes a rear site having an oval housing accommodating a cross hair, the rear site being mounted to a mounting bracket. The cross hair described in the '169 patent is a vertical wire secured by suitable fasteners so that the wire extends through and vertically across the oval housing.

The rear site of the '169 patent suffers from several drawbacks. First, the '169 patent is easily adjustable in only the vertical plane with respect to the bow frame. To accomplish horizontal adjustment, the '169 patent requires complete removal and subsequent re-attachment of the rear site from the bow frame. This feature of the '169 patent does not allow convenient horizontal adjustment in the field.

Second, the '169 patent uses an inactive system that does not place the cross hair in constant tension. Thus, the '169 patent requires the use of a rigid cross hair capable of retaining a vertical orientation. Without tension to maintain the integrity of the cross hair, inclement weather and/or humid conditions may cause a non-rigid cross hair to deteriorate and result in impaired shooting accuracy.

U.S. Pat. No. 5,040,301, describes a rear site having a pair of spaced apart, parallel sighting line members mounted behind an archery bow frame for use in compensating for improper torsional positioning. As with the '169 patent above, the '301 patent also uses an inactive system for retaining the rear sighting members in a vertical position.

Although sighting devices having front and rear sights are known in the art, many of these devices are not adapted for use with a multi-pin front sight, which is the most common and popular type of bow sight, and can be used only in conjunction with specially matched front and rear sights.

SUMMARY OF THE INVENTION

Accordingly, the present invention provides an archery bow rear sight adapted for use with any front sight, including a multi-pin front sight. The rear bow sight of the present invention has an attachment member with a first end defining one or more cavities and a second end defining a vertical slot. The attachment member is mounted to a central portion of the bow at one end and attached to an elongated member at the other. The vertical slot of the attachment member allows the rear sight of the present invention to be positioned at a preselected vertical location with respect to the central portion of the bow. The elongated member is threaded to allow the rear sight to be rotated about an axis of rotation and longitudinally adjusted with respect to the central portion of the bow.

The present invention provides a rear sighting assembly comprising a tension bearing member that is mountable to the elongated member. A cross hair is attached to each end of the tension bearing member such that the cross hair is maintained in constant tension therebetween. The tension bearing member provides an active system that maintains the cross hair in a substantially vertical orientation regardless of inclement weather conditions.

DETAILED DESCRIPTION OF THE PREFERRED EMBODIMENT

Figure 1:
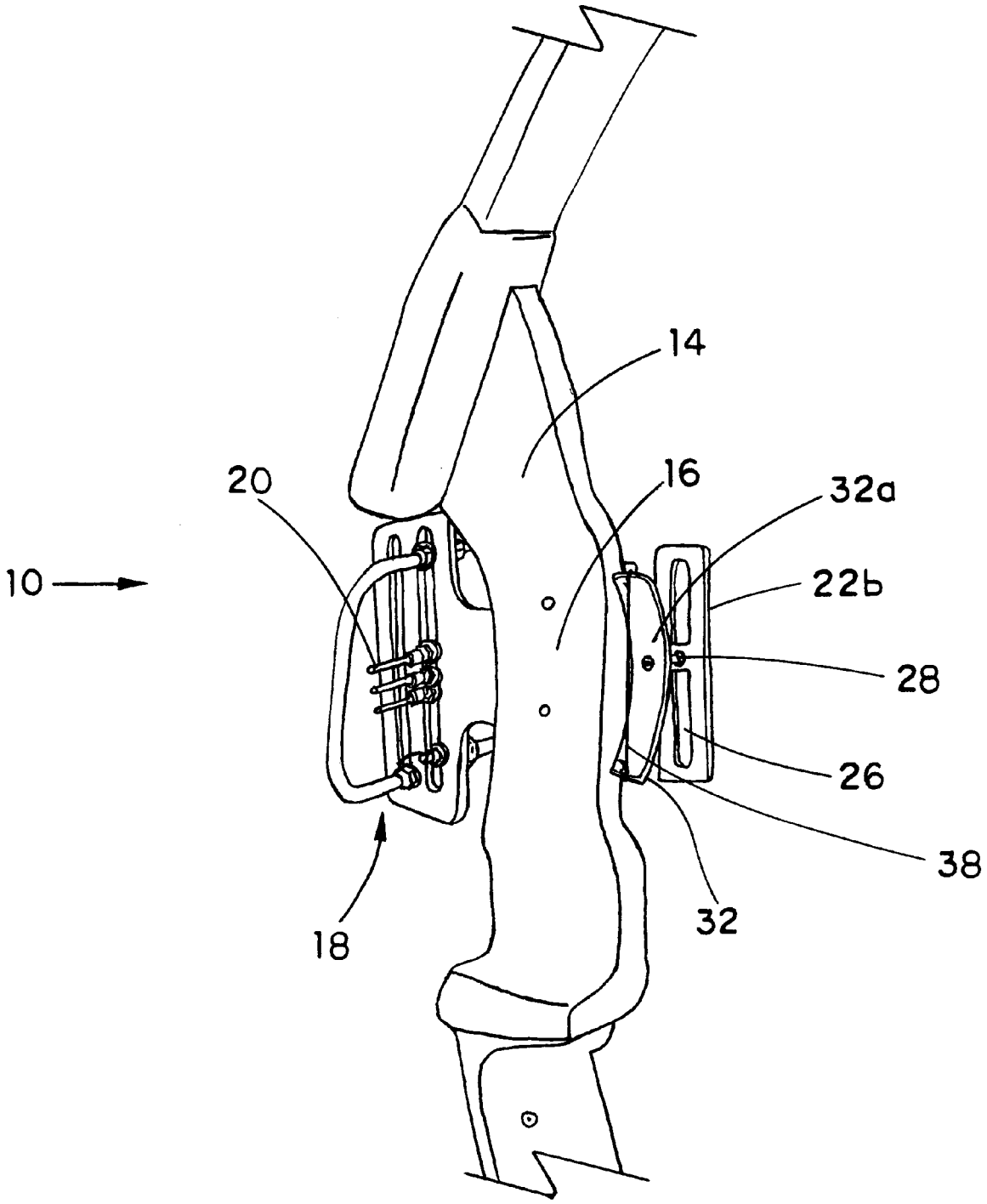
FIG. 1 is a perspective view of the central portion of the bow of the present invention having a first embodiment of the improved rear sight mounted thereto.

In the description that follows, like parts are marked throughout the specification and drawings with the same reference numerals, respectively. The drawings are not necessarily to scale and in some instances proportions have been exaggerated in order to more clearly depict certain features of the present invention.

The present invention, as illustrated in the FIG., is herein described as an improved archery bow sight (30) for use in combination with a bow (10) having a frame (14), the frame having a central portion (16) having a front sight (18) with horizontal sighting elements (20) mounted in front of the central portion (16) of the frame (14).

The rear bow sight (30) of the present invention includes an attachment member (22), an elongated member (28), and a rear sighting assembly (31). In one embodiment of the present invention, the attachment member (22) has a first end **(22*a*) having walls defining one or more cavities (24). and a second end (22*a*) having walls defining a vertical slot (26). The elongated member (28) has a first end (28***a*) and a second threaded end (22*a*) and is capable of attachment to the attachment member (22). The rear sighting assembly (31) includes a substantially vertical cross hair (38) attached to a flexible tension bearing member (32). In one embodiment, the tension bearing member (32) has first (34) and second (36) ends with an apex (32*a*) therebetween and a generally C-shaped convex surface (32*c*). First (38*a*) and second (38*b*) ends of the cross hair (38) are attached to the first (34) and second (36) ends of the tension bearing member (32) so that the cross hair is placed under tension. Attachment to each end (34 and 36, respectively) of the tension bearing member (32) causes the cross hair to tightly span from one end (34) of the tension bearing member (32) to the other (36).

The use of a tension bearing member allows the cross hair to maintain a substantially vertical orientation regardless of weather conditions. The rear sighting assembly (31) of the present invention is mountable to the elongated member (28) such that the cross hair (38) may be adjusted to intersect the horizontal sighting elements (20) of the front sight (18) at a preselected angle.

Figure 2:
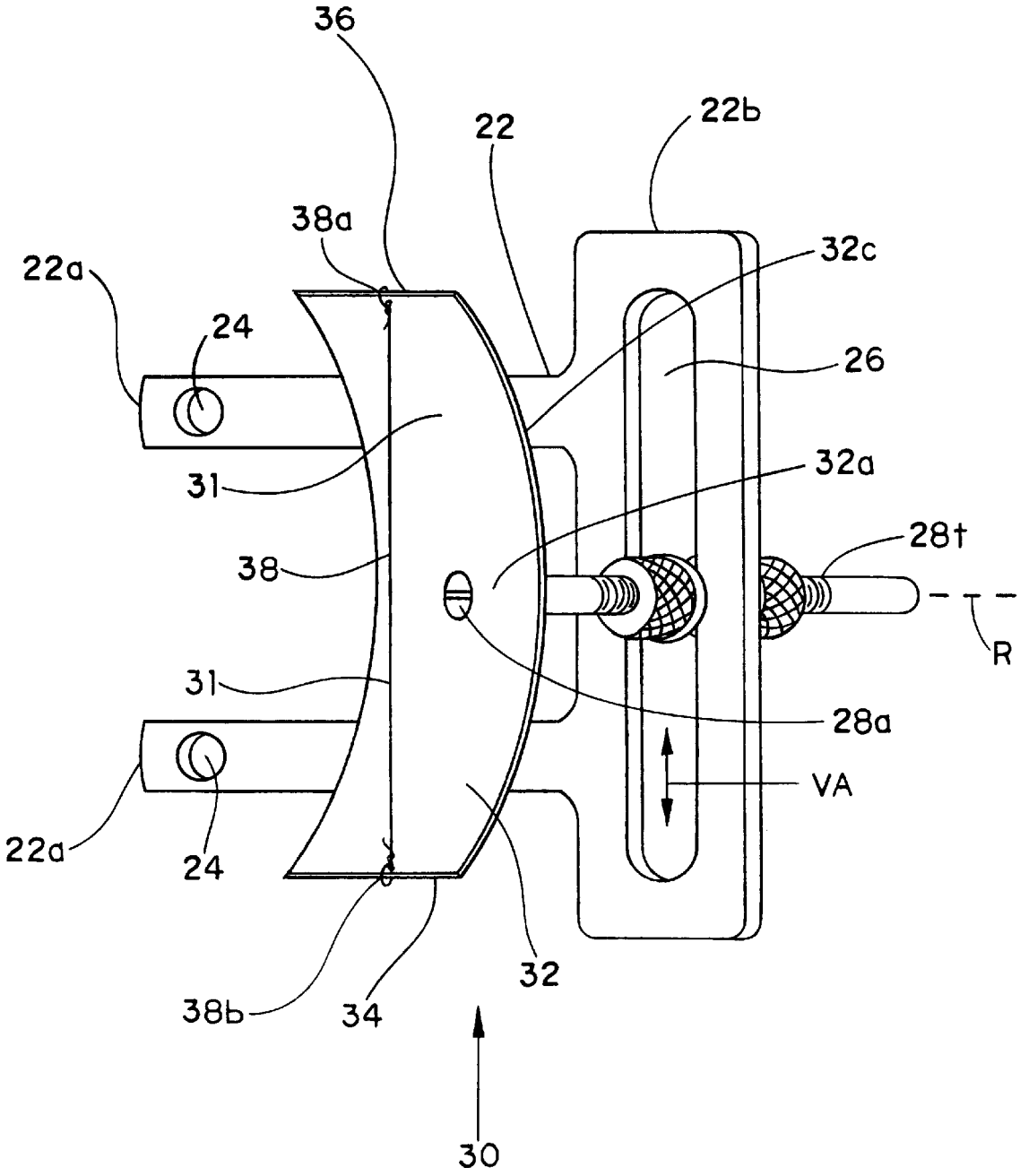
FIG. 2 is a perspective view of a first embodiment of the improved rear bow sight of the present invention.

Referring to FIGS. 1 and 2, in a first embodiment of the present invention, the first end (22*a*) of the attachment member is mounted to the central portion (16) of the frame (14) such that the second end (22*b*) of the attachment member is located rearwardly of the central portion of the frame. This is accomplished using suitable attachment means capable of insertion through the cavities (24) of the first end (22*a*) of the attachment member.

The threaded end (28*t*) of the elongated member (28) is adjustably mounted within the vertical slot (26) of the second end (22*b*) of the attachment member (22). This attachment allows the elongated member (28) to be positioned at any preselected location within the vertical slot (26), thus allowing vertical adjustment of the rear sighting assembly (31). The threaded end (28*t*) of the elongated member (28) may be mounted to the attachment member such that the elongated member is capable not only of vertical adjustment (VA) but of rotation as well. The adjustment capability of the elongated member (28) allows the tension bearing member (32) and the attached cross hair (38) to be adjusted vertically with respect to the central portion (16) of the frame (14) and rotated about an axis of rotation (R) without significant time or inconvenience. In this manner, the cross hair (38) of the rear bow site (30) may be adjusted to accommodate the preferences of the user.

The first end (28*a*) of the elongated member (28) is attached to the apex (32*a*) of the flexible tension bearing member (32). This first embodiment of the improved rear sight (30) of the present invention allows the cross hair (38) of the rear sighting assembly (31) to be extended rearwardly with respect to the central portion (16) of the frame (14) and perpendicular to the horizontal sighting elements (20) of the front sight (18). This allows the user to line up the cross hair (38) of the rear sight (30) with each horizontal sighting element (20) of the front site (18), thus improving shooting accuracy. The cross hair (38) of the present invention ay be composed of any material capable of maintaining a substantially vertical position. In one embodiment, the cross hair (38) is composed of silk string.

The tension bearing member (32) may be composed of any flexible material capable of maintaining the rigidity of the cross hair (38) by keeping it in constant tension. In one embodiment, the tension bearing number (32) is bow shaped and composed of flexible plastic.

Figure 3:
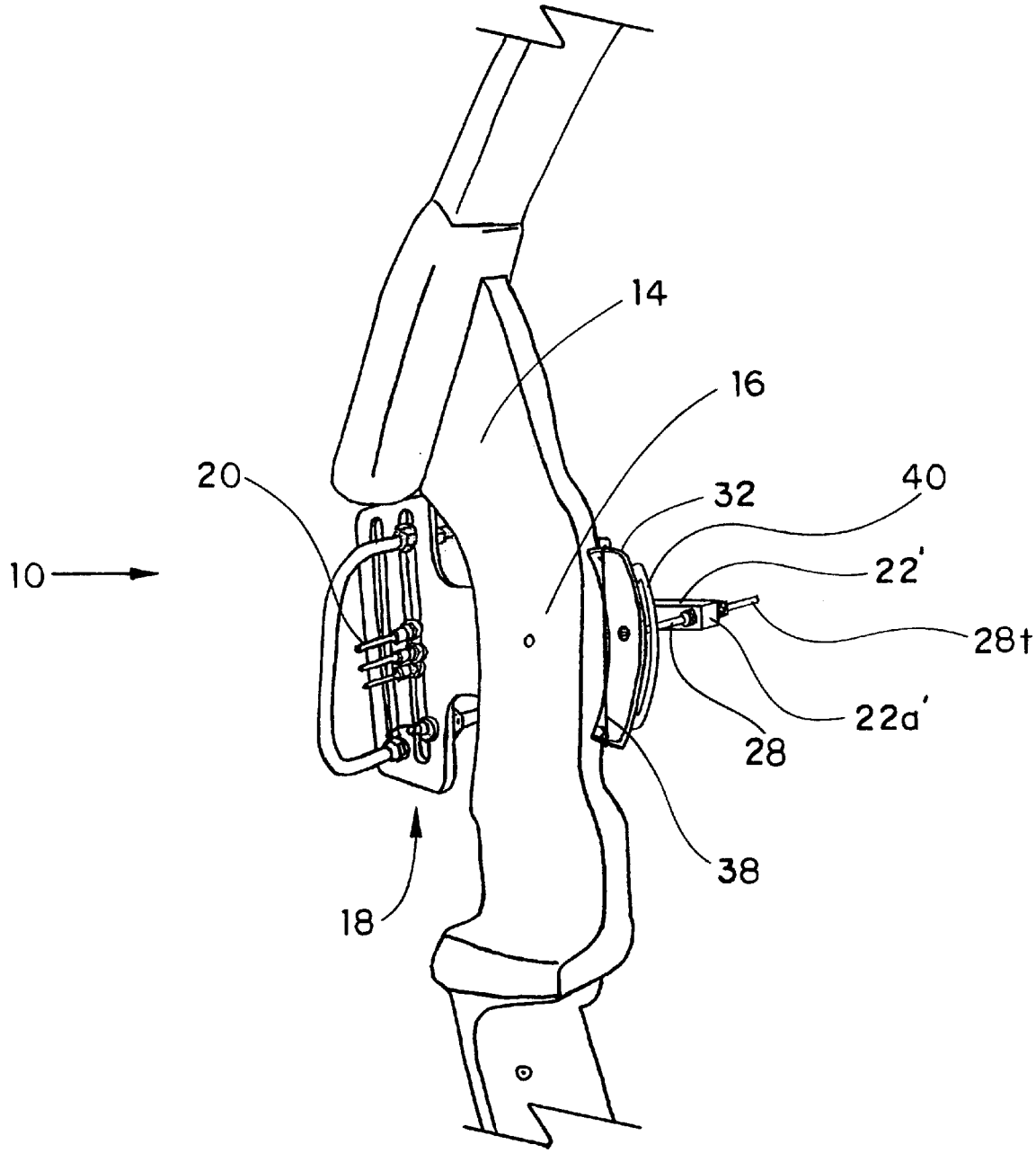
FIG. 3 is a perspective view of the central portion of the bow of the present invention having a second embodiment of the improved rear sight mounted thereto.
Figure 4:
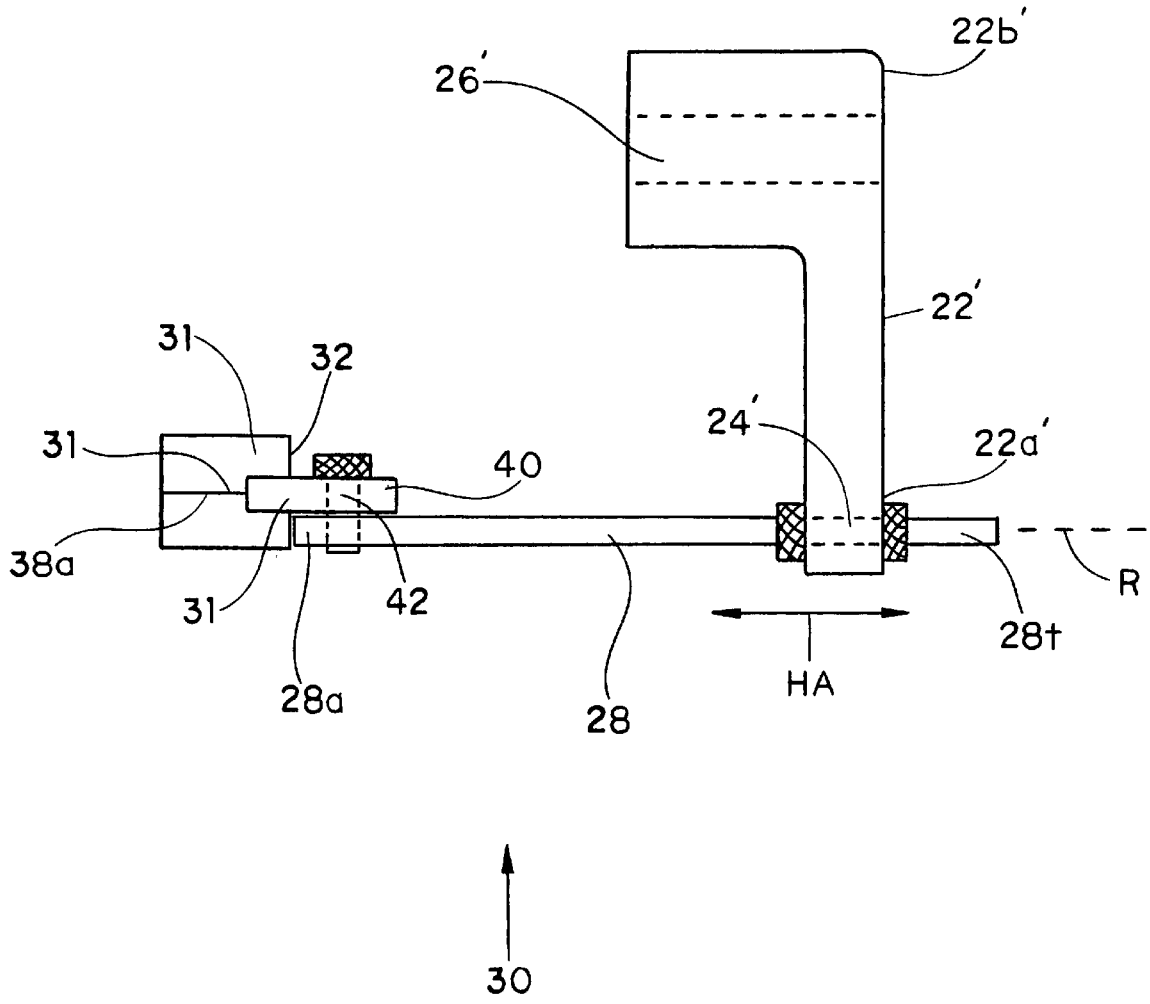
FIG. 4 is a top, cross sectional view of the second embodiment of the improved rear bow sight of the present invention.
Figure 5:
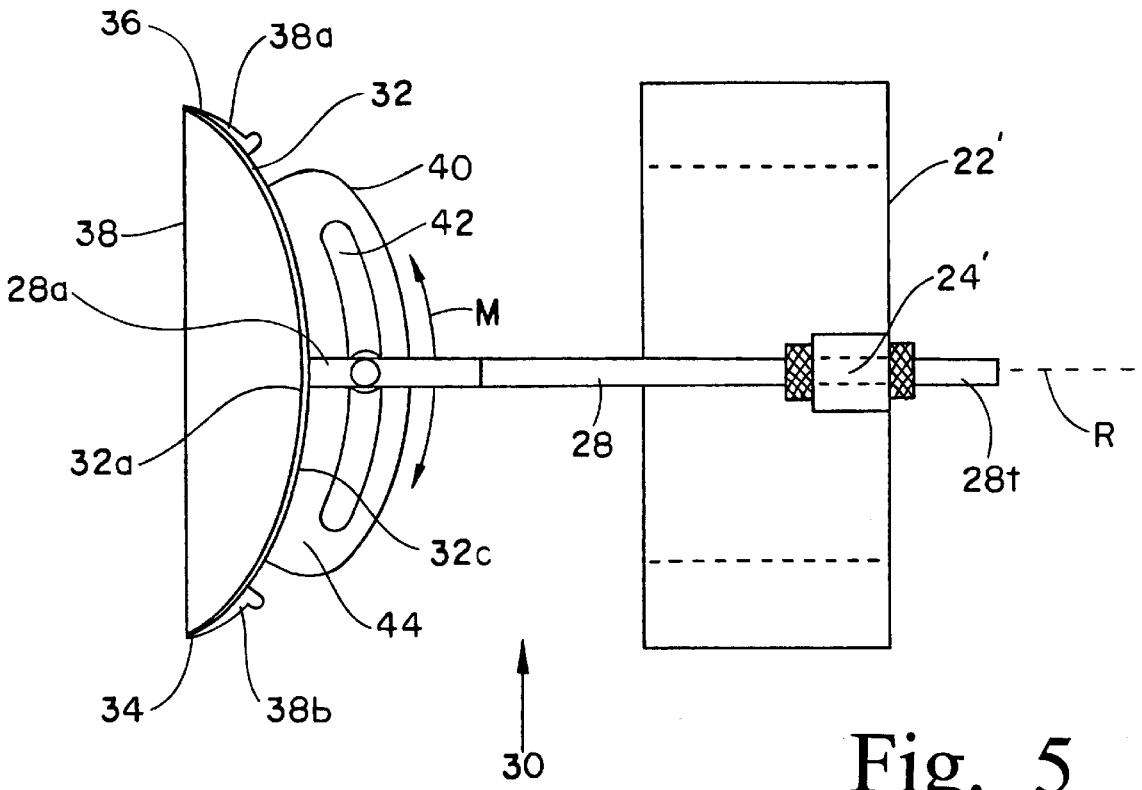
FIG 5 is a side, cross sectional, elevation view of the second embodiment of the improved rear bow sight of the present invention.

Referring to FIGS. 3, 4 and 5, in a second embodiment of the present invention, the vertical slot (26) of the second end (22*b*') of the attachment member (22) is adjustably mounted to the central portion (16) of the archery bow frame (14). This is accomplished using suitable attachment means capable of insertion through the vertical slot (26') of the second end (22*b*') of the attachment member (22'). The vertical slot (26') allows the attachment member (22') to be positioned at a preselected vertical location upon the central portion (16) of the frame (14).

The threaded end (28*t*) of the elongated member (28) is adjustably mounted longitudinally within the cavity (24) of the first end (22*a*') of the attachment member (22'). The threaded end (28*t*) may be mounted within the cavity (24') of the attachment member so as to be capable of longitudinal adjustment (HA) within the cavity. The threaded end (28*t*) of the elongated member (28) may be fixed to the cavity (24') of the attachment member (22') or mounted so as to be capable of rotation about axis of rotation (R).

The rear sighting assembly (31) of the second embodiment of the present invention further comprises a spine member (40) perpendicularly attached to the convex surface (32*a*) of the tension bearing member (32). The spine member (40) of this embodiment of the present invention has walls defining an accurate slot (42) within which the elongated member (28) is adjustably mounted. In one embodiment, the spine member (40) has a width (WS) of about 1 cm and a thickness (TS) of about 4 mm. In another embodiment, the accurate slot (42) has a width (WA) of about 4 mm.

Referring further to FIGS. 4 and 5, the first end (28*a*) of the elongated member (28) may be reasonably attached to the spine member (40) of the tension bearing member (32). Specifically, suitable attachment means may be inserted through the accurate slot (42) in order to adjustably mount the elongated member (28) to the spine member (40). The accurate slot (42) of the present invention allows the rear sighting assembly (31) to be adjustably mounted at any preselected location upon path (M).

Figure 6:
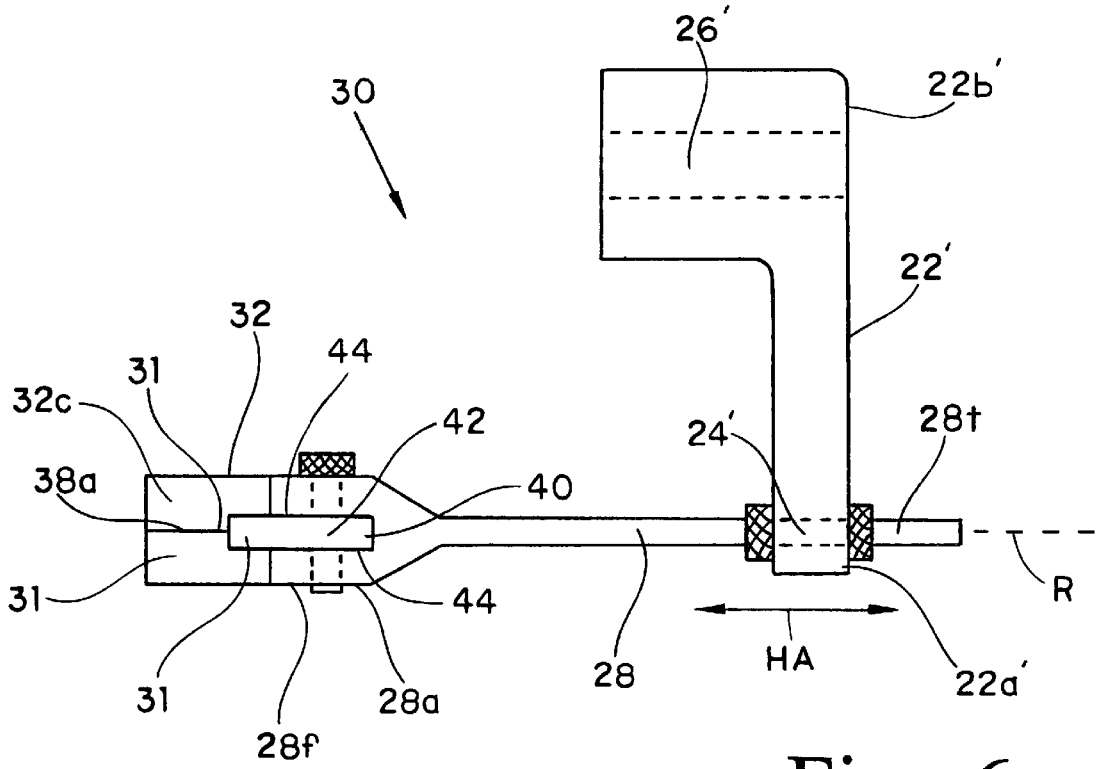
FIG. 6 is a top, cross sectional, elevation view of another embodiment of the improved rear bow sight of the present invention wherein the elongated member has a fork shaped end.

The orientation of the accurate slot (42) allows the rear sighting assembly (3 1) comprising the tension bearing member (32), spine member (40) and vertical cross hair (38), to be positioned at a preselected location upon the first end (28*a*) of the elongated member (28). Referring further to FIG. 6, the first end (28*a*) of the elongated member (28) may be equipped with a fork shaped end (28*f*) dimensioned to engage the spine member (40) of the rear sighting assembly (31). In one embodiment of the present invention, the tension bearing member (32) has a height (HT) of about 8 cm, a width (WT) of about 1.2 cm and a cross hair ( 38) to apex (32*a*) distance (D) of about 1.5 cm.

Although the invention has been described with reference to specific embodiments, this description is not meant to be construed in a limited sense. Various modifications of the disclosed embodiments, as well as alternative embodiments of the inventions will become apparent to persons 1.g skilled in the art upon the reference to the description of the invention. It is, therefore, contemplated that the appended claims will cover such modifications that fall within the scope of the invention.

I claim:

1. An improved bow sight for use in combination with a bow having a frame, said frame having a central portion, said central portion including a front sight having horizontal sighting elements mounted in front of said central portion, said improved bow sight comprising:

an attachment member having a first end having walls defining one or more cavities and a second end having walls defining a vertical slot;

an elongated member having a first end and a second threaded end, said elongated member capable of attachment to said attachment member;

a rear sighting assembly mountable to said elongated member, said rear assembly comprising;

a flexible tension bearing member having a generally C-shaped convex surface and having a first end and a second end with an apex therebetween;

a substantially vertical cross hair having a first end and a second end attached to said tension bearing member so as to be under tension; and said rear sighting assembly adjustably mountable to said elongated member such that said cross hair may be positioned to intersect said horizontal sighting elements of said front sight at a preselected angle.

2. The bow sight of claim 1, wherein said first end of said attachment member is adapted to be mounted to said central portion of said frame such that said second end of said attachment member is located rearwardly of said central portion of said frame.

3. The bow sight of claim 2, wherein said threaded end of said elongated member is adapted to be adjustably mounted within said vertical slot of said attachment member, said elongated member capable of being positioned at a preselected vertical location within said vertical slot.

4. The bow sight of claim 3, wherein said first end of said elongated member is adapted to be attached to said apex of said tension bearing member.

5. The bow sight of claim 3, wherein said first end of said elongated member is adapted to be rotatably attached to said apex of said tension bearing member.

6. The bow sight of claim 4, wherein said cross hair of said rear sighting assembly is perpendicular to said horizontal sighting elements of said front sight so as to locate a target thereon.

7. The bow sight of claim 5, wherein said cross hair of said rear sighting assembly is perpendicular to said horizontal sighting elements of said front sight so as to locate a target thereon.

8. The bow sight of claim 1, wherein said second end of said attachment member is adapted to be adjustably mounted to said central portion of said frame such that said first end of said attachment member is located rearwardly of said central portion of said frame, said attachment member being capable of being positioned at a preselected vertical location within said vertical slot.

9. The bow sight of claim 8, wherein said threaded end of said elongated member is adapted to be adjustably mounted longitudinally within said cavity of said first end of said attachment member, said elongated member capable of rotation within said attachment member.

10. The bow sight of claim 8, wherein said threaded end of said elongated member is adapted to be adjustably mounted longitudinally within said cavity of said first end of said attachment member, said elongated member capable of longitudinal adjustment within said cavity of said first end of said attachment member.

11. The bow sight of claim 9, wherein said rear sighting assembly further comprises a spine member perpendicularly attached to said convex surface of said tension bearing member.

12. The bow sight of claim 11, wherein said spine member further comprises walls defining an accurate slot upon which said first end of said elongated member may be adjustably mounted.

13. The bow sight of claim 11, wherein said spine member has etched surfaces to produce increased friction upon attachment to said elongated member.

14. The bow sight of claim 12, wherein said first end of said elongated member is fork shaped and dimensioned to engage said spine member of said rear sighting assembly.

15. The bow sight of claim 1, wherein said tension bearing member comprises a plastic bow shaped member.

16. The bow sight of claim 8, wherein said tension bearing member comprises a plastic bow shaped member.

17. An improved bow sight for use in combination with a bow having a frame, said frame having a central portion, said central portion including a front sight having horizontal sighting elements mounted in front of said central portion, said improved bow sight comprising:

an attachment member having a first end having walls defining a cavity and a second end having walls defining a vertical slot, said attachment member adjustably mountable to said central portion of said frame such that said first end of said attachment member is located rearwardly of said central portion of said frame and capable of being positioned at a preselected vertical location within said vertical slot;

an elongated member having a first end and a second threaded end, said threaded end adjustably mountable longitudinally within said cavity of said attachment member, said elongated member capable of rotation and longitudinal adjustment within said cavity of said attachment member;

a rear sighting assembly mountable to said first end of said elongated member, said rear assembly comprising;

a flexible tension bearing member having a generally C-shaped convex surface and having a first end and a second end with an apex therebetween;

a substantially vertical cross hair attached to said bow member so as to be under tension;

a spine member perpendicularly attached to said convex surface of said bow member, said spine member having walls defining an accurate slot and dimensioned for receipt within said forked end of said elongated member; and said rear sighting assembly adjustably mountable to said elongated member so that said cross hair may be positioned to intersect and be substantially perpendicular to said horizontal sighting elements of said front sight at a preselected angle.

18. The bow sight of claim 17, wherein said spine member has etched surfaces to produce increased friction upon attachment to said elongated member.

19. The bow sight of claim 17, wherein said flexible tension bearing member comprises a molded plastic bow shaped member.

20. The bow sight of claim 17, wherein said first end of said elongated member is forked shaped and dimensioned for receiving said spine member of said rear sighting assembly.

* * * * *